US006971293B2

(12) United States Patent
Appenzeller et al.

(10) Patent No.: US 6,971,293 B2
(45) Date of Patent: Dec. 6, 2005

(54) SCREWDRIVER WITH A SCREW HOLDER

(75) Inventors: Andreas Appenzeller, Biel (CH); Stephan Rupp, Davos-Dorf (CH); Romano Mark, Davos (CH)

(73) Assignee: Synthes (U.S.A.), Paoli, PA (US)

( * ) Notice: Subject to any disclaimer, the term of this patent is extended or adjusted under 35 U.S.C. 154(b) by 48 days.

(21) Appl. No.: 10/755,894

(22) Filed: Jan. 12, 2004

(65) Prior Publication Data

US 2005/0178252 A1 Aug. 18, 2005

Related U.S. Application Data

(63) Continuation of application No. PCT/CH01/00437, filed on Jul. 12, 2001.

(51) Int. Cl.[7] ..... B25B 23/08
(52) U.S. Cl. ..... 81/177.85; 81/125; 81/448
(58) Field of Search ..... 81/177.85, 438, 81/125, 13, 448

(56) References Cited

U.S. PATENT DOCUMENTS 2,800,822 A * 7/1957 Allred ..... 81/125
2,811,883 A * 11/1957 Cleaves ..... 81/124.1
3,286,749 A * 11/1966 Learned ..... 81/448
3,436,107 A * 4/1969 Karden ..... 403/315
4,007,768 A * 2/1977 Matsushima ..... 81/448
4,060,114 A * 11/1977 Matsushima ..... 81/448
5,237,893 A 8/1993 Ryder et al.
5,323,673 A * 6/1994 Martinez et al. ..... 81/125

FOREIGN PATENT DOCUMENTS

EP 0 458 449 A 11/1991
WO WO 00 20174 A 4/2000

* cited by examiner

*Primary Examiner*—David B. Thomas
(74) *Attorney, Agent, or Firm*—Jones Day

(57) ABSTRACT

A screwdriver is disclosed having a shaft with a screw holder. The screw holder is receivable in a recess in a screw head, and has a spring element which can be elastically deformed transverse to the longitudinal axis of the shaft. A portion of the spring element may be engaged with a bore in the shaft and the bore may penetrate the front end of the shaft. The elastic segment may be disposed in a groove parallel to the longitudinal axis of the shaft segment so that, in the unstressed state of the spring element, at least a portion of the elastic segment protrudes beyond the cross-sectional surface of the shaft segment to engage a surface of the screw head recess to thereby retain the screw on the shaft.

17 Claims, 2 Drawing Sheets

SCREWDRIVER WITH A SCREW HOLDER

CROSS REFERENCE TO RELATED APPLICATION

This application is a continuation of the U.S. national phase designation of co-pending international application PCT/CH01/00437 to Appenzeller, filed Jul. 12, 2001, the entirety of which application is hereby incorporated by reference thereto.

FIELD OF THE INVENTION

The invention relates to a screwdriver with a screw holder.

BACKGROUND OF THE INVENTION

So that, during the surgical implantation of an implant, which is to be fastened to a bone, a bone fragment or a joint of the human or animal body, the surrounding soft tissue experiences the least possible damage, it should be possible to carry out surgery on the bone or, for example, a segment of the spine without exposing large areas of the parts to be treated (i.e. using a minimally invasive technique). For very small openings in the soft tissue, forceps, for example, are then no longer suitable for introducing bone or pedicle screws.

A screwdriver with means for holding a screw is known from the EP 0 458 449 to RYDER. This known screwdriver comprises a longitudinal shaft part with a free end, which can be introduced into a corresponding recess in the head of a screw. The elastic means, by which the screws are clamped, are embedded in a groove, which is parallel to the longitudinal axis of the shaft, and consists of a compressible elastomer. Since the elastic means, in the uncompressed state, protrude radially over at least one side surface of the shaft part, they are compressed into a complementary recess during the insertion of the shaft part and pressed against the side wall of the recess, as a result of which the head of the screw is held at the shaft part. It is a disadvantage of this embodiment of the elastic means that, as the shaft part is being pushed into a complementary recess in the head of a screw, the elastic means are not compressed and, instead, may be pushed away by the front end of the shaft part.

It is an object of the invention to create a screwdriver with an elastic screw holder, so that the screw holder cannot be bent back at a screw head while the screwdriver is being introduced into a suitable recess. Furthermore, the elastic means are to be configured so that the screw holder has a tendency to expand radially as the screw head is being pulled from the screwdriver, as a result of which the pull-off force is enhanced. Furthermore, it shall be possible to produce the elastic means also from metallic materials.

Pursuant to the invention, this objective is accomplished by a screwdriver with a screw holder, which has the distinguishing features described below.

SUMMARY OF THE INVENTION

The inventive screwdriver with a screw holder comprises a shaft, which is connected at its rear shaft section with driving means, such as a handle or a machine, and a front shaft segment, which can be introduced into a recess, suitable for the screwdriver, such as a hexagon socket or a TORX at a screw head, as well as a spring element, which can be deformed elastically transversely to the longitudinal axis of the front segment of the shaft, and at least one fixed segment, which can be connected with the shaft, as well as at least one elastic segment. Preferably, the elastic segment is disposed in a groove parallel to the longitudinal axis of the shaft segment, so that, in the unstressed state of the spring element, at least a portion of the elastic segment protrudes over the cross-sectional surface of the shaft segment, viewed parallel to the longitudinal axis. The fixed segment of the spring element is fastened in a borehole, which penetrates from the end face of the shaft segment into the latter. The borehole has an axis, which forms an angle of $90° > \alpha > 0°$ with the longitudinal axis of the shaft segment.

The advantages, achieved by the invention, are seen to lie in that, due to its inventive configuration, the spring element, when the front segment of the shaft is pushed into a complementary recess in a screw head, is pressed against the longitudinal axis and deformed elastically, even if the spring element, in the unstressed state, protrudes relatively far over the cross-section of the front segment of the shaft. By these means, a relatively large restraining force can be exerted on the screw head without running the risk that the elastic means will be bent.

In the preferred embodiment of the inventive screwdriver, the angle $\alpha$, formed between the axis of the borehole and the longitudinal axis of the shaft, is between 35° and 55°. Due to this configuration with an angle $\alpha$, which is not too flat, the spring element is prevented from being pulled out of the borehole when the screwdriver is pulled out of the screw head. By selecting an angle $\alpha$, which is not too steep, the installation of the spring wire at the peg is made possible and simplified.

In the unstressed state, the spring element, perpendicularly to the longitudinal axis, protrudes over the cross sectional surface of the front shaft segment by an amount H, viewed parallel to the longitudinal axis. Preferably, this amount H is between 0.2 mm and 0.8 mm. Due to the configuration of the screw holder as a spring wire with a fixed segment, which is pressed into a borehole that penetrates from the end face into the front segment of the shaft, the distance H can be larger than in the case of screw holders, which are disposed detached at the front segment of the shaft. Due to the larger value for H, a greater deformation of the spring element is attained during the insertion into a corresponding recess at a screw head, as a result of which a high clamping force of the screw holder can be attained.

The ratio $Q_1/Q_2$ between the cross-sectional area $Q_1$ of the spring element and the cross-sectional area $Q_2$ of the front segment of the shaft preferably is between 0.06 and 0.01. Such cross-sectional ratios are produced, for example, by an external hexagon with a width of 3.5 mm across the flats and a spring wire with a diameter of 0.8 mm or by an external hexagon with a width of 2.5 mm across the flats and a spring wire with a diameter of 0.3 mm.

Further advantageous developments of the invention are given in the dependent claims.

BRIEF DESCRIPTION OF THE DRAWINGS

The invention and further developments of the invention are explained in greater detail in the following by means of partial diagrammatic representation of several examples. In the drawings.

DETAILED DESCRIPTION OF THE INVENTION

Figure 1A:
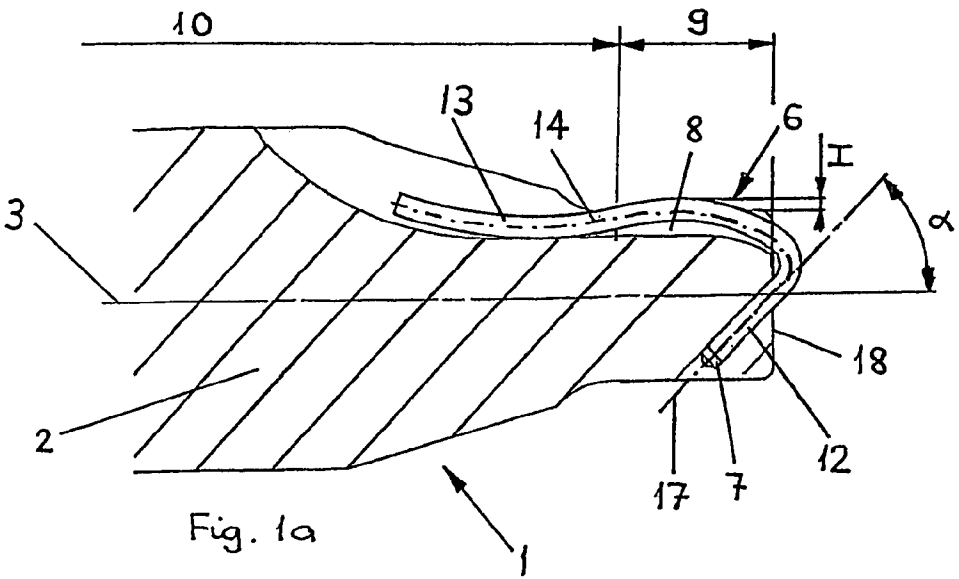
FIG. 1*a* is a longitudinal cross-section of the inventive screwdriver with screw holder.
Figure 1B:
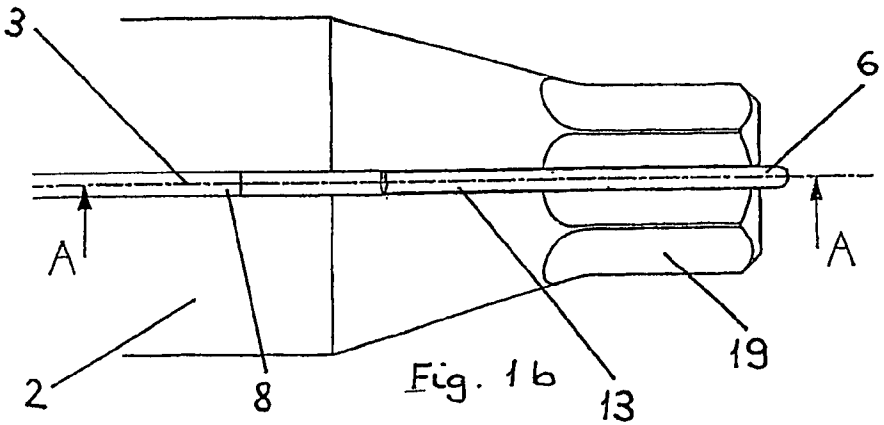
FIG. 1*b* is a top view of the screwdriver with screw holder shown in FIG. 1*a,*
Figure 1C:
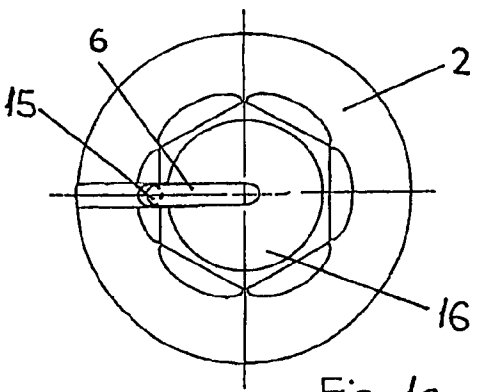
FIG. 1*c* is a front view of the screwdriver with screw holder shown in FIGS. 1*a* and 1*b* and FIG. 2 is a longitudinal cross-section of a second embodiment of the inventive screwdriver with screw holder.

The screwdriver 1 with screw holder, shown in FIGS. 1*a* to 1*c*, comprises a longitudinal shaft 2 with a longitudinal axis 3, a rear shaft segment 10 and a front shaft segment 9, the end of which has a face 18, which is perpendicular to the longitudinal axis 3, and a spring element 6, which can be elastically deformed transversely to the longitudinal axis 3. The front segment 9 of the shaft is configured to be complementary to the recesses in the screw heads, which are to be used, and is configured, for example, as an external hexagon.

The spring element 6 is a bent, metallic spring wire with a first cross sectional area 15 and comprises a fixed segment 12, which is coaxial with the central axis 14, and an elastic segment 13, which is also coaxial with the central axis 14. The fixed_segment 12 of the spring element 6 is pressed into a borehole 7, which penetrates from the end face 18 of the front shaft segment 9 into the shaft 2. The elastic segment 13 extends in S-shaped fashion from the outlet of the borehole 7 at first radially at the end face 18 and subsequently in a groove 8, which is sunk parallel to the longitudinal axis 3 into the shaft 2. At the front segment 9 of the shaft, the spring element 6 protrudes radially from the groove 8 and, in the unstressed state, protrudes by an amount H, measured perpendicularly to the longitudinal axis 3, beyond the second cross sectional area 16 of the front segment 9 of the shaft. This height is reduced towards the rear end of the shaft 10.

The axis 17 of the borehole 7 intersects the end face 18 of the shaft 2 at an angle, so that an angle $\alpha$ is formed between the axis 17 of the borehole and the longitudinal axis 3.

Figure 2:
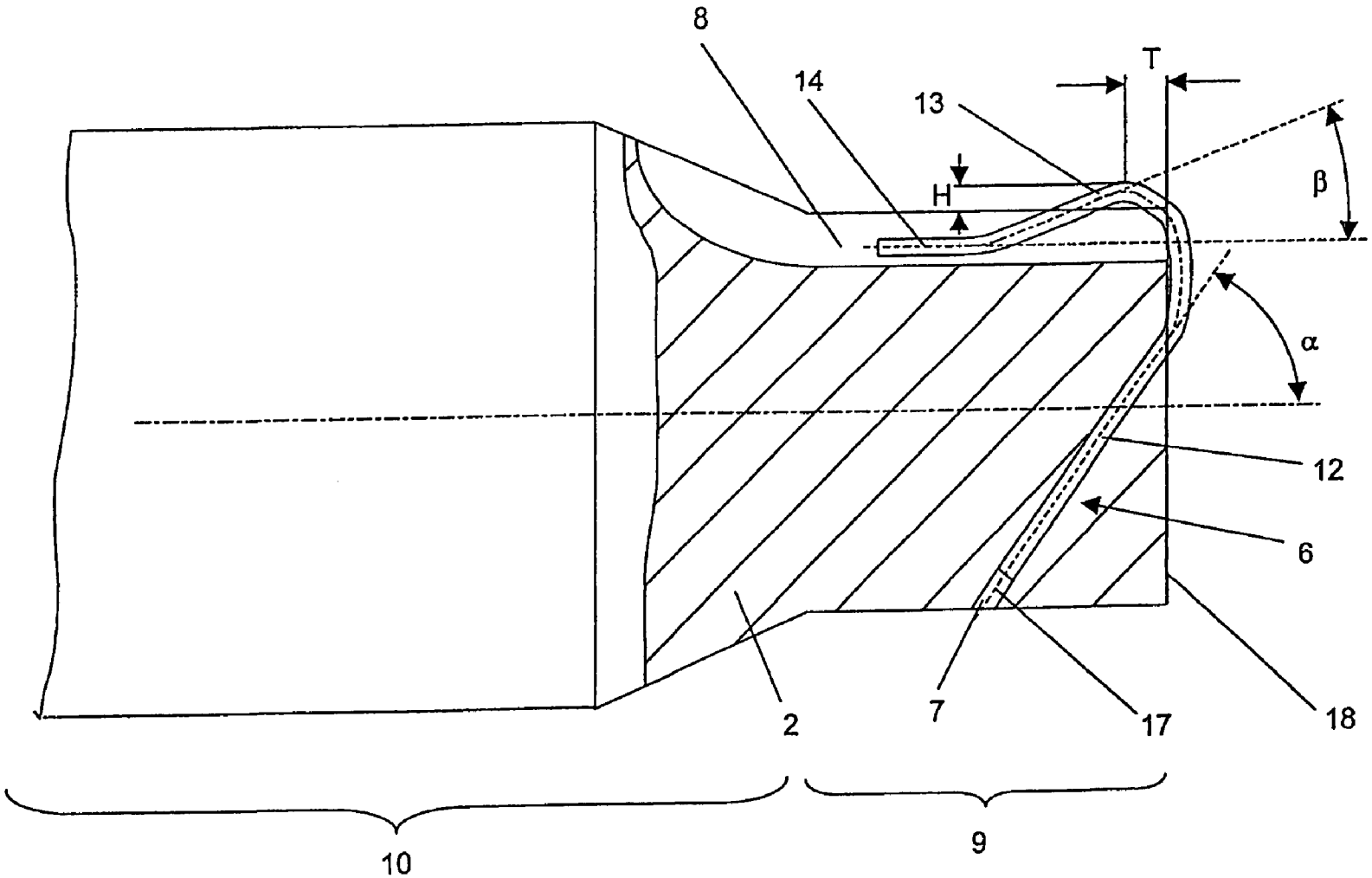

A further embodiment of the inventive screwdriver with a screw holder is shown in FIG. 2. The spring element 6 is pressed with a fixed segment 12 into a borehole 7 in the front segment 9 of the shaft 2. The axis 17 of this borehole 7 encloses an angle $\alpha$ with the longitudinal axis 3 of the screwdriver, the borehole 7 terminating in the end face 18 of the shaft 2. The elastic segment 13 of the spring element 6 is bent in such a manner that, along a portion of its length perpendicular to the longitudinal axis 3, it protrudes by an amount H beyond the shaft 2. This amount H reaches its maximum at a depth T of the end face 18 of the shaft 2, viewed parallel to the longitudinal axis 3, the depth T amounting to between 0.5 mm and 3 mm. Further away from the end face 18, the amount H decreases once again. In this part of the elastic segment 13, the central axis 14 of the spring element 6 forms an angle $\beta$ of between 3 of between 3° and 30° with the longitudinal axis 3 and the spring element 6 can be accommodated in the groove 8.

While the invention has been shown and described herein with reference to particular embodiments, it is to be understood that the various additions, substitutions, or modifications of form, structure, arrangement, proportions, materials, and components and otherwise, used in the practice and which are particularly adapted to specific environments and operative requirements, may be made to the described embodiments without departing from the spirit and scope of the present invention. Accordingly, it should be understood that the embodiments disclosed herein are merely illustrative of the principles of the invention, and that various modifications may be made by those skilled in the art which will embody the principles of the invention and fall within the spirit and the scope thereof.

What is claimed is:

1. A tool comprising:

(a) a shaft having a front portion engageable with a screw head, a rear portion connectable to a handle, and a longitudinal axis, wherein the front portion has a borehole, and an end face substantially perpendicular to the longitudinal axis of the shaft;

wherein the borehole has a longitudinal axis;

(b) a spring element disposed in the borehole having an elastic portion and a fixed portion, wherein at least a portion of the elastic portion can be deflected transversely to the longitudinal axis of the shaft;

wherein at least a portion of the fixed portion is fastened in the borehole;

wherein at least a portion the spring element extends past the end face of the front portion; and wherein the longitudinal axis of the borehole forms an angle between about 35 degrees and about 55 degrees with the longitudinal axis of the shaft.

2. The tool of claim 1, wherein the front portion further comprises a groove, and wherein at least a portion the spring element is placed in the groove.

3. The tool of claim 1, wherein the spring element has first cross-sectional area, and wherein the end face has a second cross-sectional area.

4. The tool of claim 3, wherein the second cross-sectional area is substantially larger than the first cross-sectional area.

5. The tool of claim 1, wherein at least a portion of the elastic portion exerts an axial force on a portion of a screw head when the tool engages a screw head.

6. The tool of claim 1, wherein the end face is substantially hexagonal in shape.

7. The tool of claim 1, wherein the screw head is substantially hexagonal in shape.

8. The tool of claim 1, wherein the spring element extends a first distance past the end face of the front portion.

9. The tool of claim 8, wherein the first distance is between about 0.2 mm and about 0.8 mm.

10. The tool of claim 1, wherein the spring element is a substantially cylindrical spring wire.

11. The tool of claim 10, wherein the spring element has a diameter of between about 0.3 mm and about 0.8 mm.

12. A tool comprising:

(a) a shaft having a front portion engageable with a screw head, a rear portion connectable to a handle, and a longitudinal axis, wherein the front portion has a borehole, at least one side face, and an end face substantially perpendicular to the longitudinal axis of the shaft;

wherein the borehole has a longitudinal axis;

(b) a spring element disposed in the borehole having an exposed portion, and a portion housed in the borehole, wherein at least a portion of the elastic portion can be deflected transversely to the longitudinal axis of the shaft;

wherein at least a portion the spring element extends past the end face of the front portion; and wherein the borehole extends from the end face through at least one side face.

13. The tool of claim 12, wherein the longitudinal axis of the borehole forms an angle substantially less than 90 degrees with the longitudinal axis of the shaft.

14. The tool of claim 12, wherein the at least a portion of the portion of the spring element housed in the borehole is fastened within the borehole.

15. A tool comprising:

(a) a shaft having a front portion engageable with a screw head, a rear portion connectable to a handle, and a longitudinal axis, wherein the front portion has a borehole, and an end face substantially perpendicular to the longitudinal axis of the shaft;

wherein the borehole has a longitudinal axis;

(b) a spring element disposed in the borehole having an exposed portion, and a portion housed in the borehole, wherein at least a portion of the elastic portion can be deflected transversely to the longitudinal axis of the shaft;

wherein at least a portion the spring element extends past the end face of the front portion; and wherein the opening of the borehole at the end face of the front portion is substantially aligned with the longitudinal axis of the shaft.

16. The tool of claim 15, wherein the longitudinal axis of the borehole forms an angle substantially less than 90 degrees with the longitudinal axis of the shaft.

17. The tool of claim 15, wherein the at least a portion of the portion of the spring element housed in the borehole is fastened within the borehole.

* * * * *